United States Patent [19]

Henzl et al.

[11] Patent Number: 4,557,299

[45] Date of Patent: Dec. 10, 1985

[54] METHOD OF AND APPARATUS FOR SELECTIVELY RELEASING A PREDETERMINED LENGTH OF WEFT THREAD IN SHUTTLELESS LOOMS

[75] Inventors: Jindřich Henzl, Brno; Vladimír Kuda, Blazovice; Vladimír Vašíček, Moravsky Krum; Stanislav Klimes, Brno, all of Czechoslovakia

[73] Assignee: ZVS Vyzkumnevyvojovy Ustav Koncernova Ucelova Organizace, Brno, Czechoslovakia

[21] Appl. No.: 593,021

[22] Filed: Mar. 23, 1984

[30] Foreign Application Priority Data

May 16, 1983 [CS] Czechoslovakia ..... 3398-83

[51] Int. Cl.[4] ..... D03D 47/36

[52] U.S. Cl. ..... 139/452; 242/47.01

[58] Field of Search ..... 139/452; 242/47.01, 242/47.12

[56] References Cited

U.S. PATENT DOCUMENTS

| | | | |
|---|---|---|---|
| 3,513,882 | 5/1970 | Strauss | 139/452 |
| 3,587,664 | 6/1971 | Van Mullekom | 139/452 |
| 4,372,349 | 2/1983 | Van Mullekom | 139/452 |
| 4,462,434 | 7/1984 | Takegawa | 139/452 |

FOREIGN PATENT DOCUMENTS

| | | | |
|---|---|---|---|
| 123403 | 6/1967 | Czechoslovakia | 139/452 |
| 166740 | 12/1976 | Czechoslovakia | 139/452 |
| 2751380 | 5/1978 | Fed. Rep. of Germany | 139/452 |
| 2062700 | 5/1981 | United Kingdom | 139/452 |
| 2107742 | 5/1983 | United Kingdom | 139/452 |

*Primary Examiner*—Henry S. Jaudon
*Assistant Examiner*—S. Shongut

[57] ABSTRACT

A method of and an apparatus for selectively releasing a predetermined length of weft thread in shuttleless looms, wherein a separating wheel provided with a control on the periphery thereof, having unequal heights or angular spacings, displaces a winding of weft thread, having an insertion length and wound in a space between two controls, in the direction of withdrawal of the weft thread, along a supply drum comprised of segments and always releases at least one complete insertion length of weft thread into the warp shed at a time period determined by a weft thread releasing program.

8 Claims, 19 Drawing Figures

Figure 1:
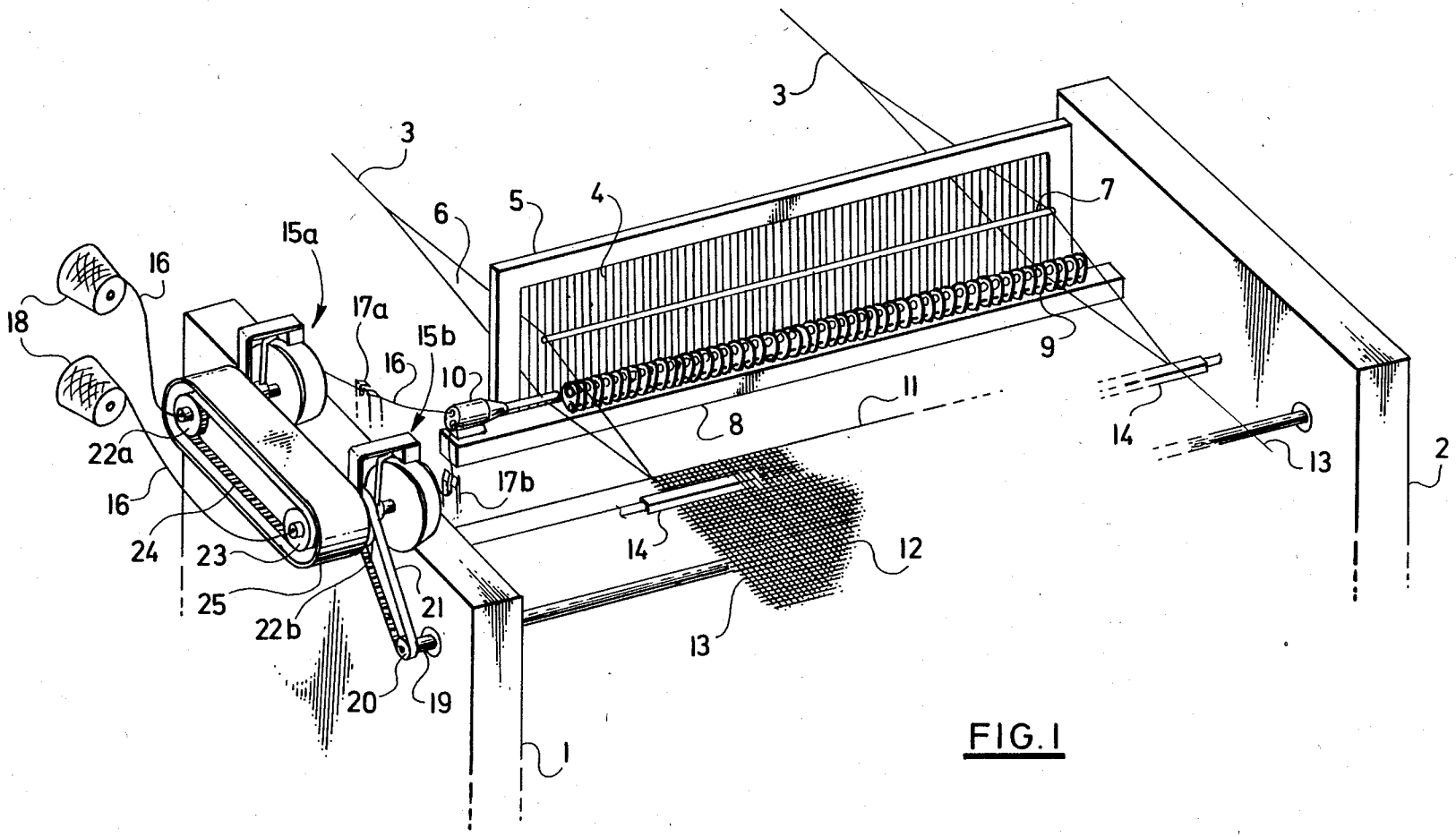

METHOD OF AND APPARATUS FOR SELECTIVELY RELEASING A PREDETERMINED LENGTH OF WEFT THREAD IN SHUTTLELESS LOOMS

The present invention relates to a method of and an apparatus for selectively releasing a predetermined length of weft thread into the warp shed in a shuttleless loom by using continuously rotating metering devices, each of which is provided with a separating wheel, on the periphery of which there are disposed control means.

In existing shuttleless looms mixing of wefts and subsequent insertions of the latter into the warp sheds are effected from metering devices to which the weft threads are continuously fed from a magazine containing supply bobbins and wound on a suitable drum or winder in order to adjust the tension in the weft threads, to separate the individual metered windings, and then to selectively insert the respective weft thread into the warp shed, as disclosed in Czechoslovak patent specification No. 166,740.

Metering of a predetermined length of weft thread and delivery thereof from a weft thread magazine take place in conjunction with an intermittent operation of the loom by using a metering mechanism consisting of several metering strands of endless belts which are moved continuously, substantially in the same direction, and at the same speed, the predetermined length of weft thread being deposited by means of a winding guide onto the metering belts in a single-layer spiral, transversely to the direction of their movement, in such a way that no slipping between the weft thread and the metering belts occurs in the direction of their movement. After each predetermined number of coils, the weft thread is separated by several metering guides mounted at predetermined distances on the outer surface of at least one of the metering belts, whereby the length of the weft thread is being metered. The weft thread coils are conveyed by the metering belts, at a uniform speed, in the predetermined direction and in the terminal section of the metering belts the direction of the leading portion of the weft thread coils is changed in such a way that it runs around the front metering guide of the respective pair of neighboring metering guides and advances in the direction of movement of the endless belt. Upon starting the intermittent operation of the loom, the weft thread is released from said metering guide so that it can be fed into the loom. When the weft thread releasing program is to be changed, it is necessary to change the endless belts.

Further, there is known a device according to Great Britain patent specification No. 2,062,700, wherein a weft supply is wound on a drum, the beginning surface of which is oblique and merges into a conical portion tapering in the picking direction. The metered lengths of weft thread are held by pins protruding through the drum surface at right angles to the rotation axis of the drum, there being a plurality of said pins which are controlled by a planetary gear. The pins separate the individual weft thread windings having the required insertion length and release them onto the conical portion where they are locked by a locking means disposed proximate the delivery end of the drum, until the moment of their release into the warp shed. Said locking means is displaced between its operative and inoperative positions and is controlled in accordance with the releasing program.

There is also a known metering device according to German DE-OS No. 27 51 380, the nature of which resides in that a stationary winding drum is provided with a plurality of pins which are advanced above the drum surface, one by one, and are displaced in the axial plane of the drum. The prins are driven according to a fixed transmission ratio relative to the rotation speed of a flyer. The pins are successively pushed out, one by one, from the interior of the drum through a recess, into the winding area around the drum and after having been displaced in axial direction they again leave said winding area. The pins are fixed to a disc mounted for rotation in the axial plane in the interior of the drum.

Furthermore, there is a known weft thread metering device according to Czechoslovak patent specification No. 123,403, wherein a weft thread is continuously wound by a flyer onto a metering drum and into a groove of a disc, due to the intermittent rotary motion of which the weft thread winding corresponding to the width of warp shed, is displaced onto a supply drum on which it is loosely deposited until the moment of insertion into the warp shed. The moment of insertion of the weft thread into the warp shed is determined by the winding of one to two coils of weft thread on the metering drum and into the groove of the disc. A disadvantage of the device resided particularly in that the weft thread winding is loosely deposited on the supply drum so that the weft thread winding can slop off the supply drum prior to insertion into the warp shed. These metering devices can be used for weft thread releasing 1:1 or one after the other.

These shortcomings are eliminated by a method of selectively releasing a predetermined length of weft thread into the warp shed in shuttleless looms, the nature of which resides in that always the first control means, in the direction of withdrawal of the weft thread, releases selectively, according to a weft thread releasing program, a weft thread carried behind it, into the warp shed. An advantage of the method resides in a simple change of the weft thread releasing program and, particularly, in a common operation in separating and controlling the weft thread by just one part, i.e. the control means, with a relatively short transfer distance of the weft thread along a supply drum.

The nature of the apparatus for selectively releasing a predetermined length of weft thread into the warp shed in shuttleless looms resides in that on the periphery of a separating wheel there are distributed at least three control means at equal angular spacings and having unequal relative heights determined by the weft thread releasing program, or having unequal relative heights and unequal angular spacings determined by the weft thread releasing program, or having equal heights and variable angular spacings determined by the weft thread releasing program.

Figure 2:
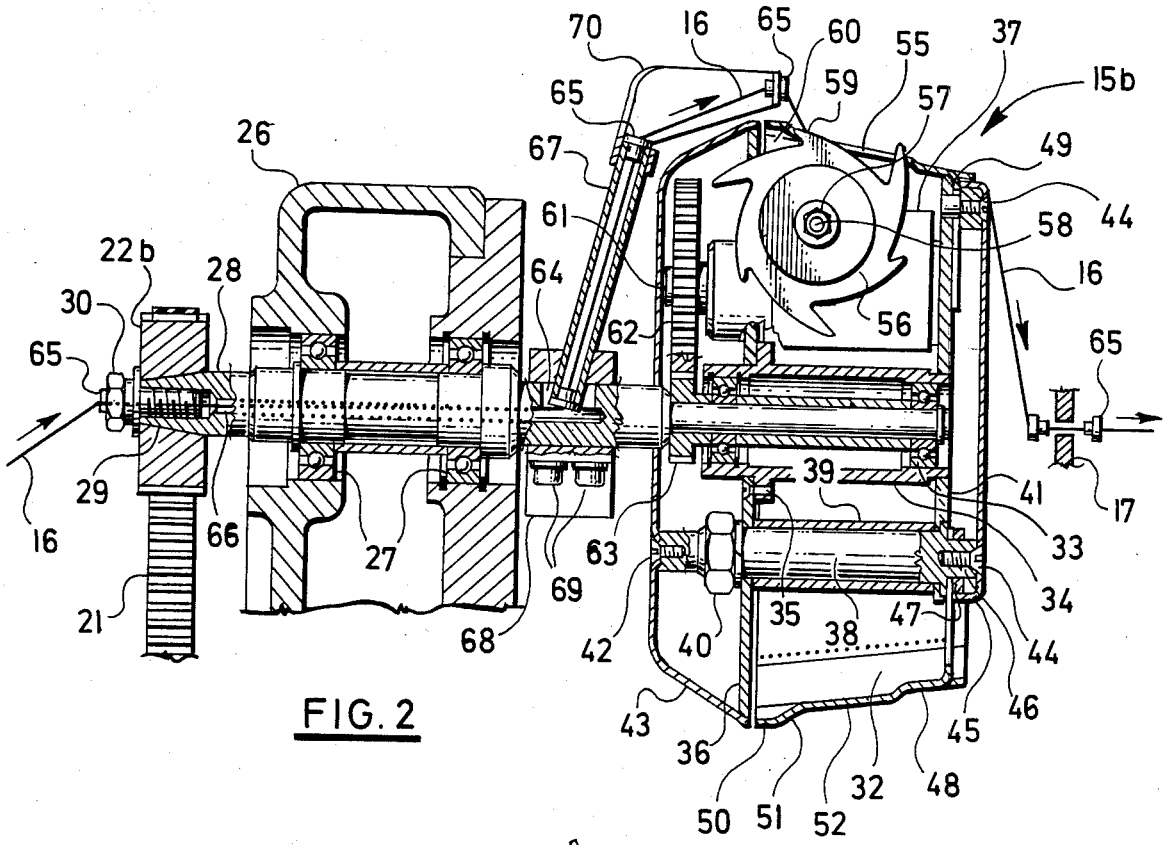
Figure 10:
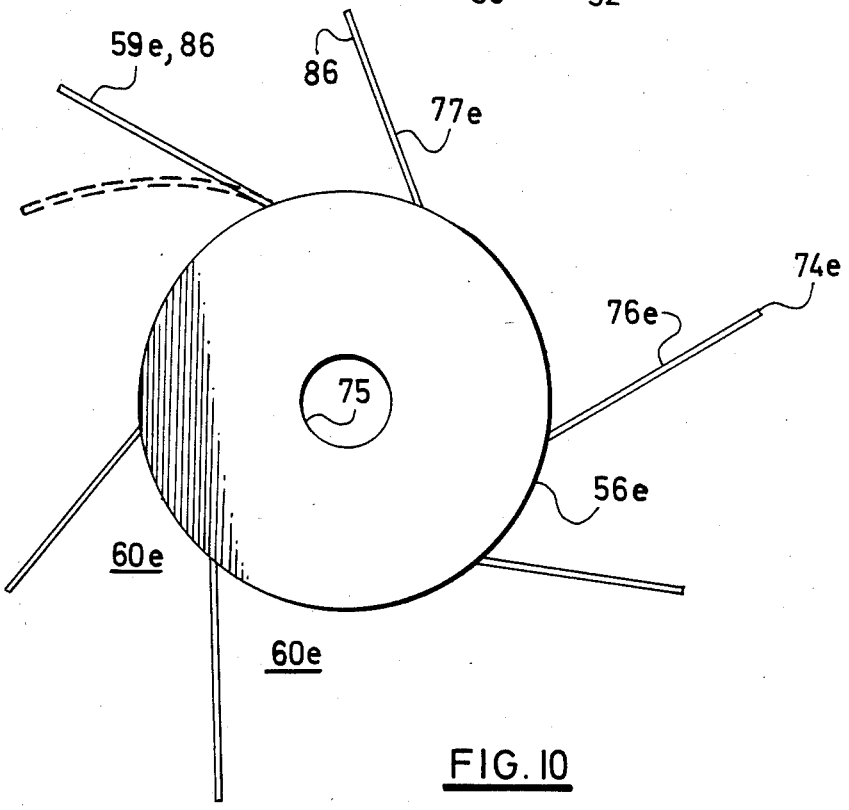
Figure 3:
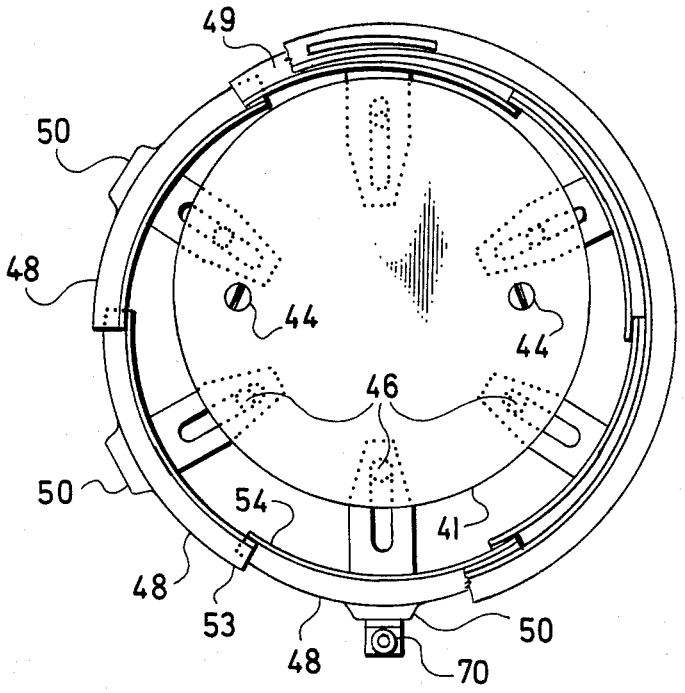
Figure 4:
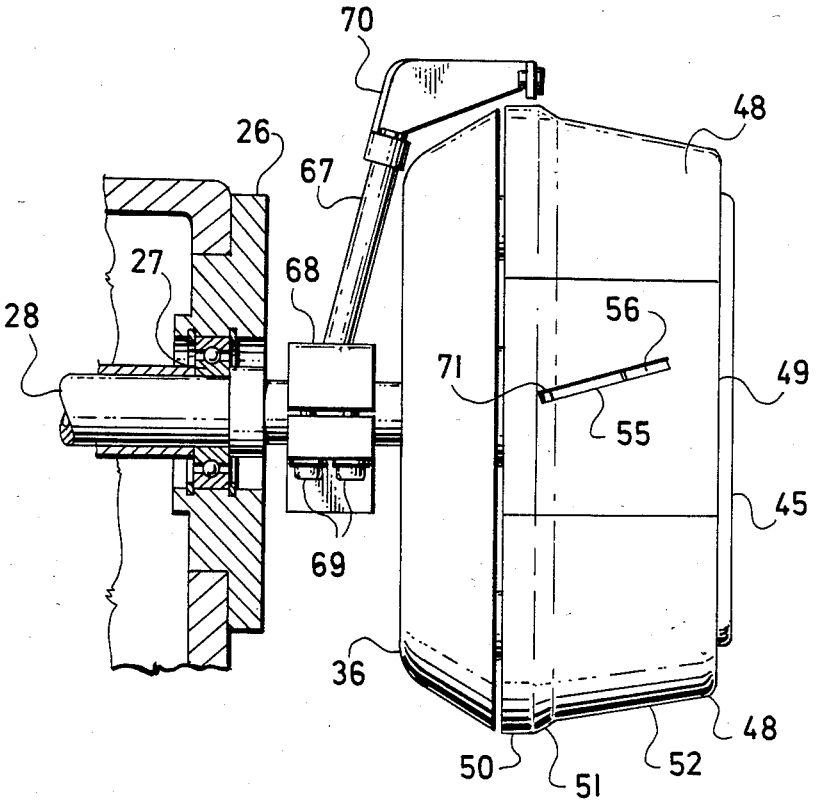
Figure 5A:
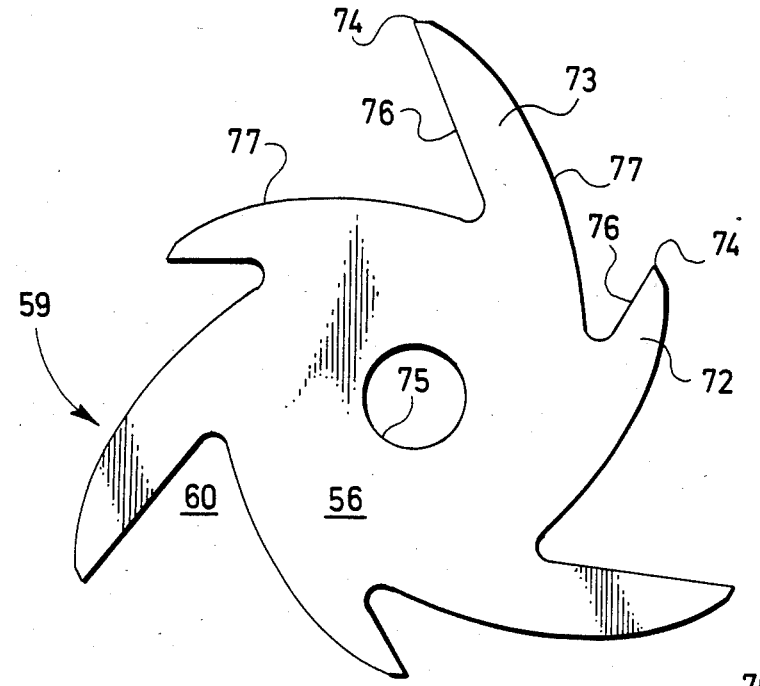
Figure 5B:
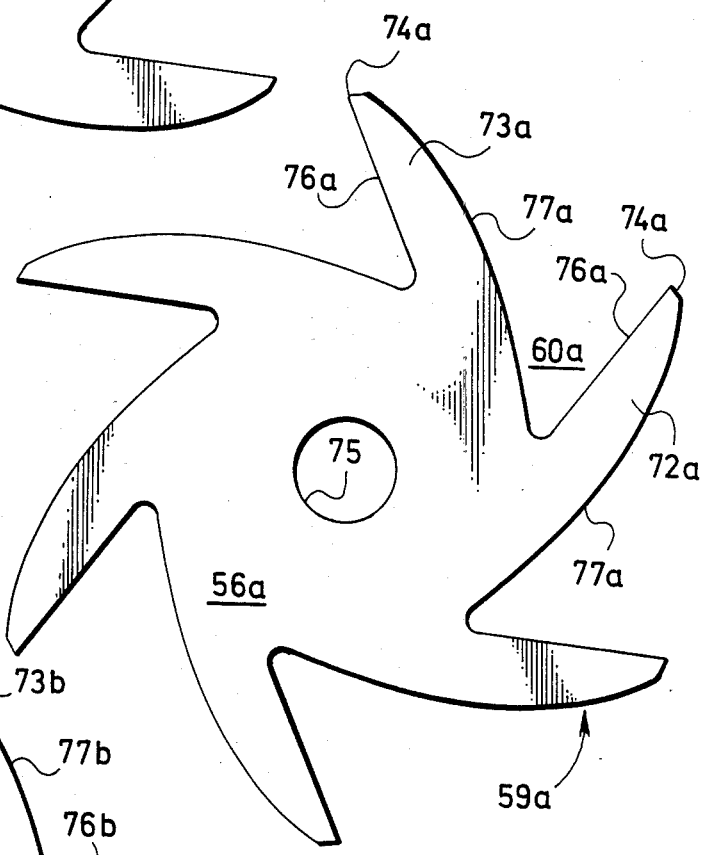
Figure 6:
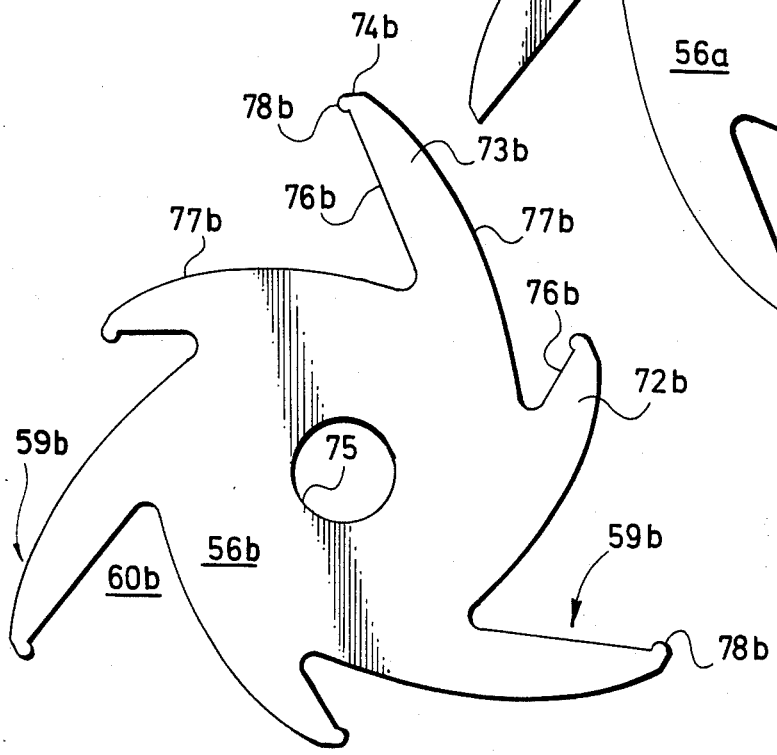
Figure 7:
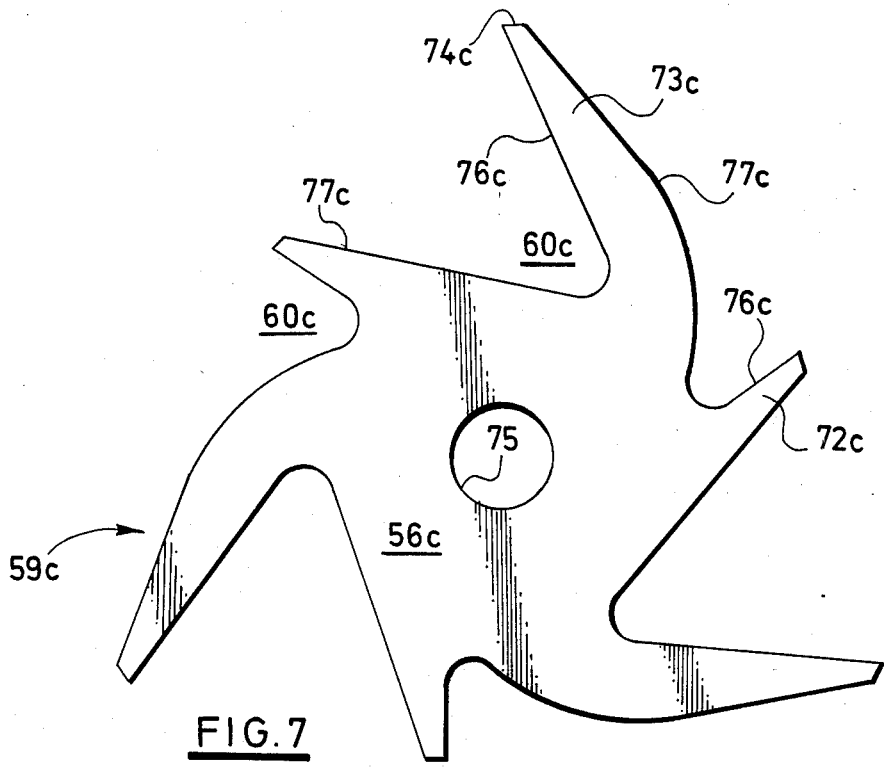
Figure 8:
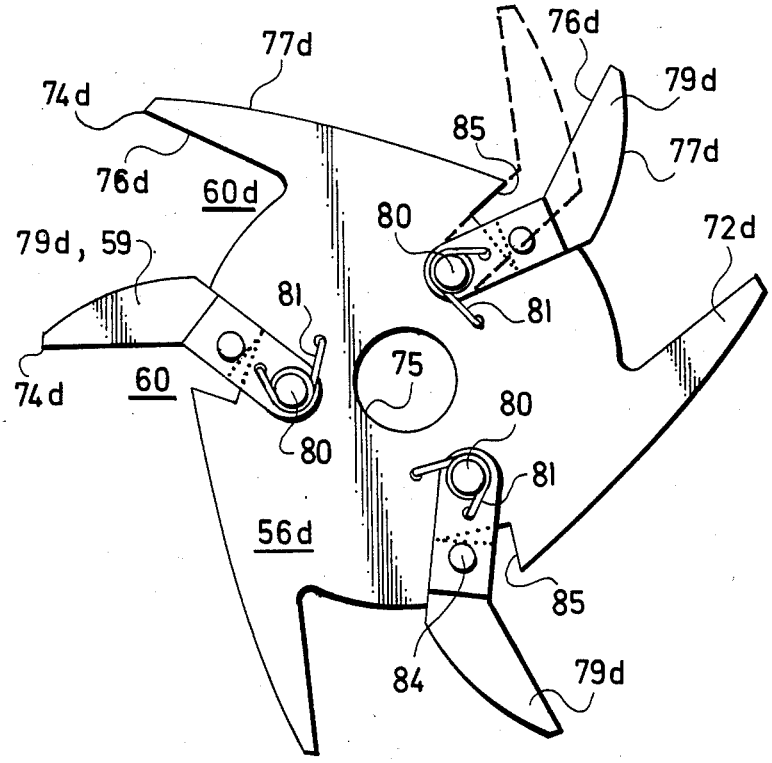
Figure 9:
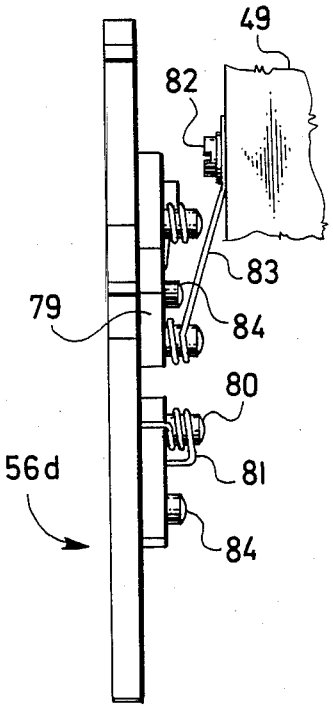
Figure 11:
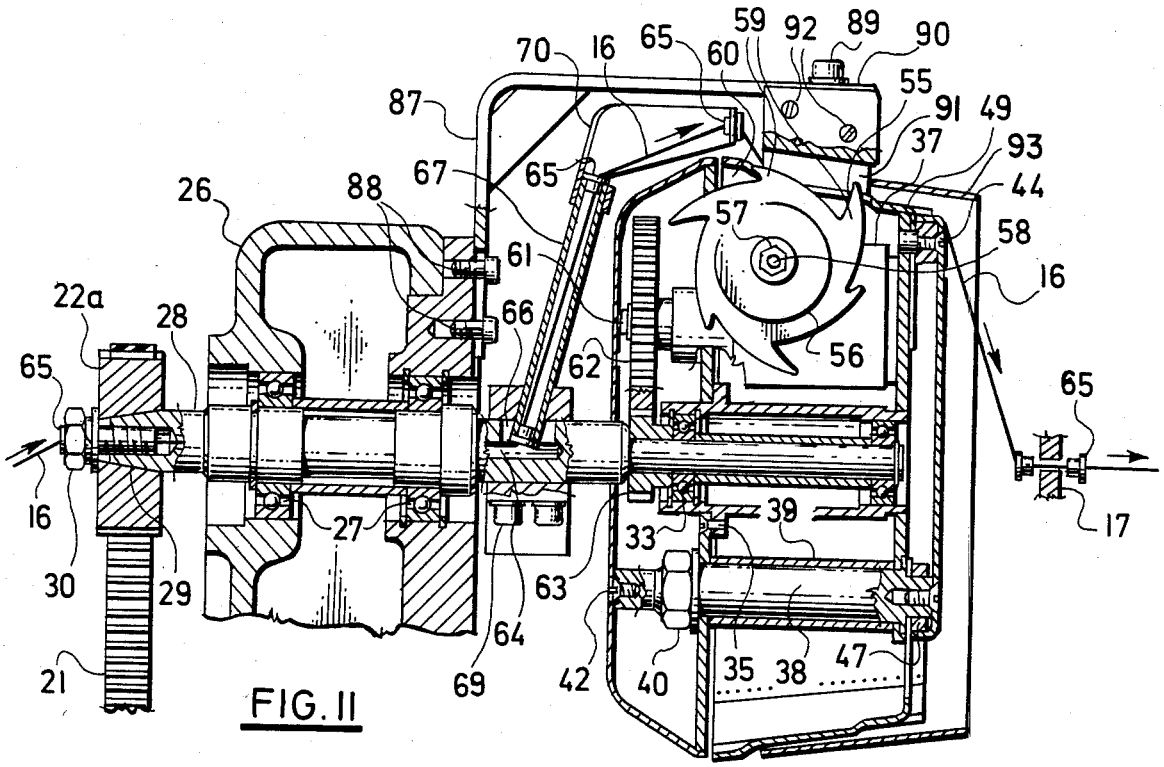
Figure 12:
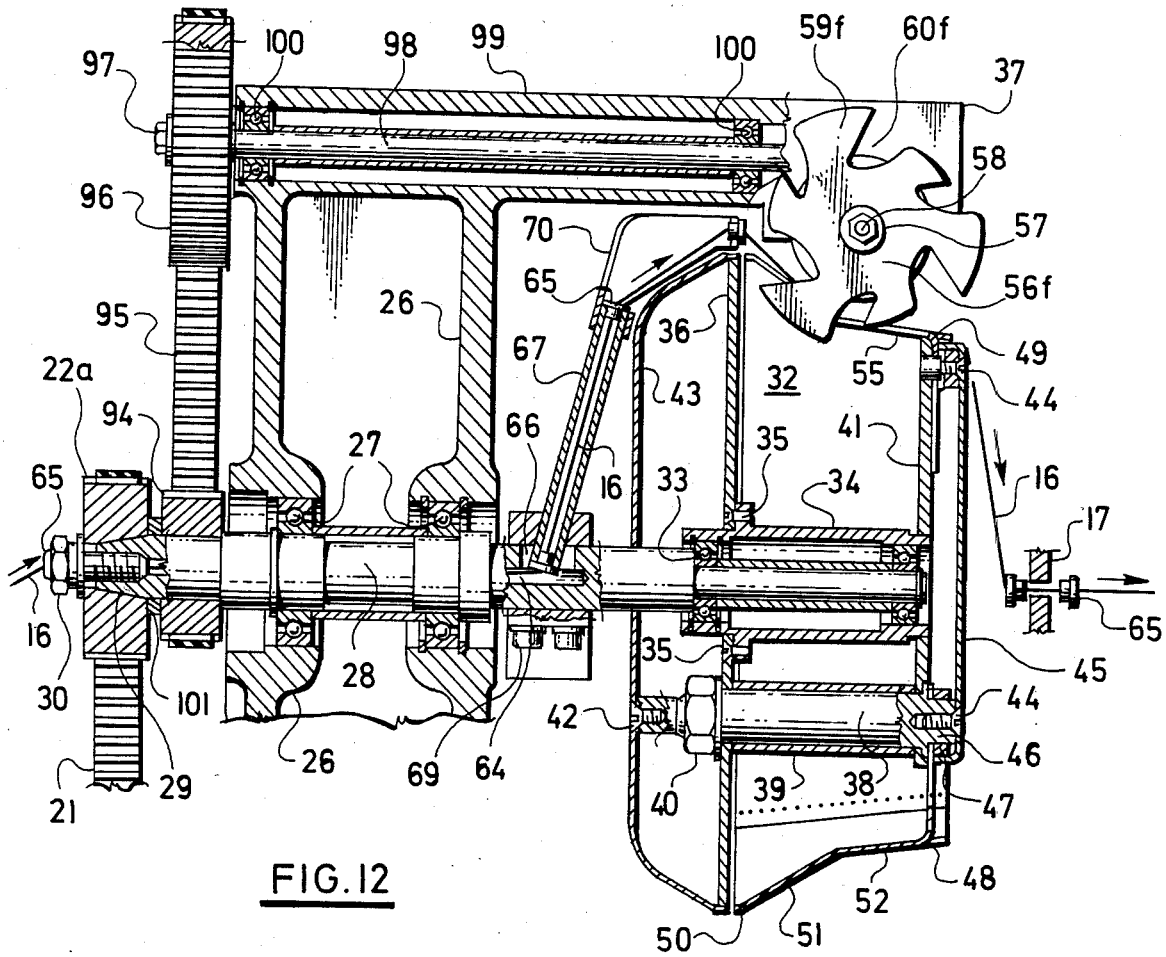
Figure 13:
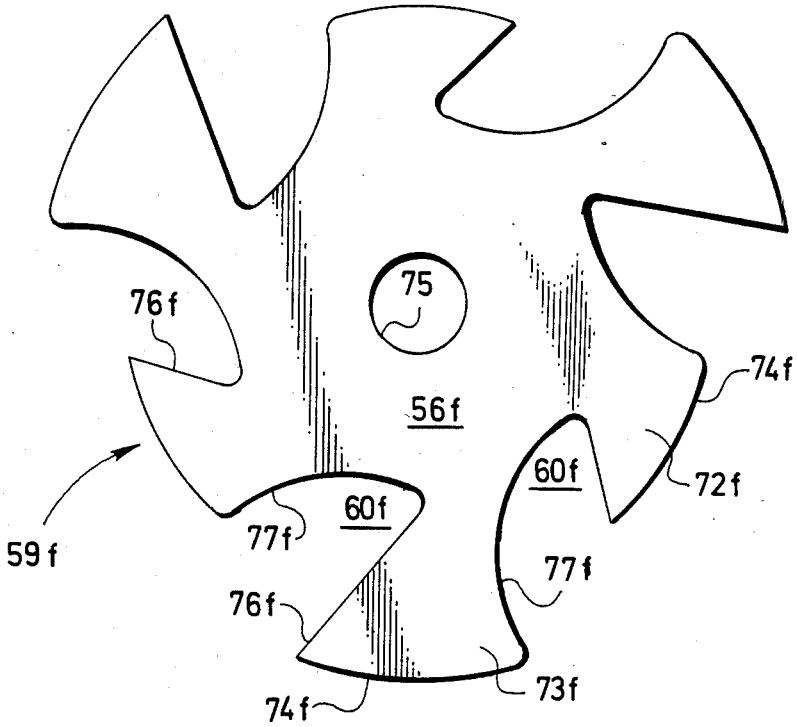
Figure 17:
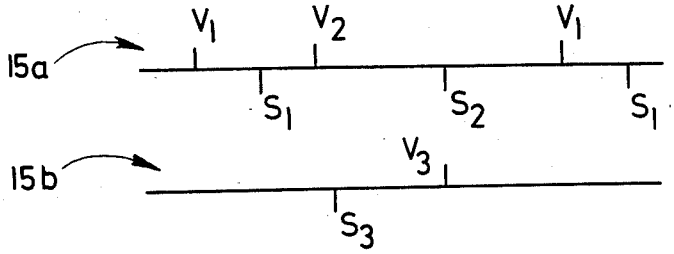
Figure 18:
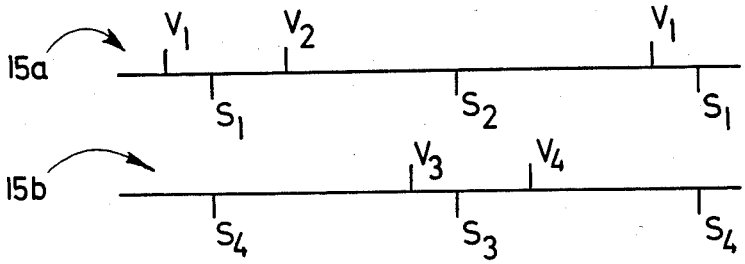
Figure 14:
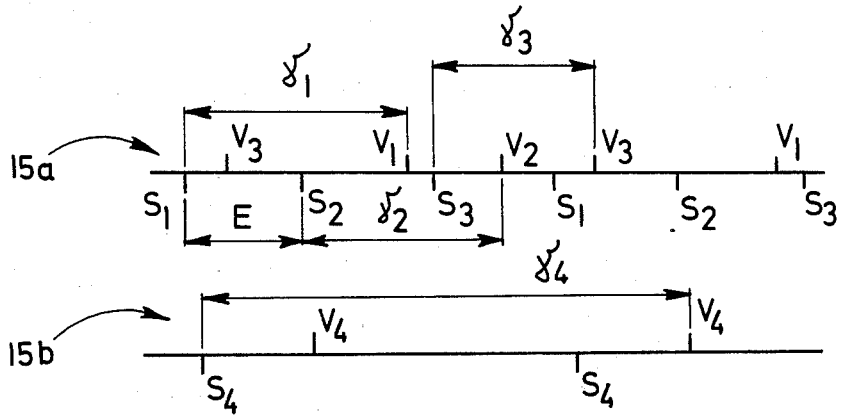
Figure 15:
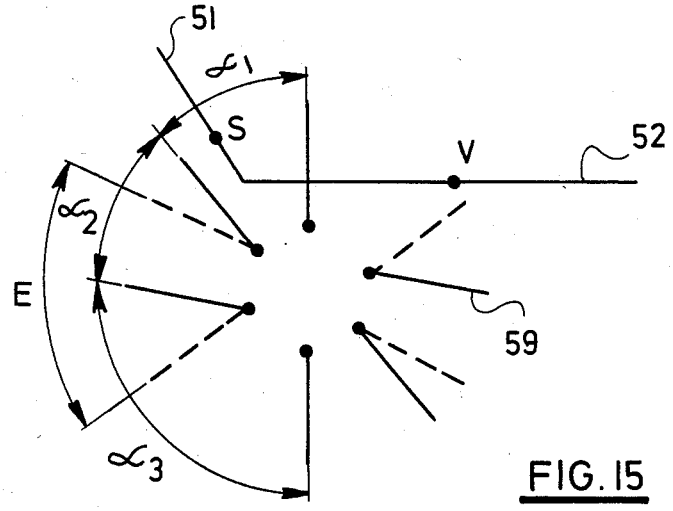
Figure 16:
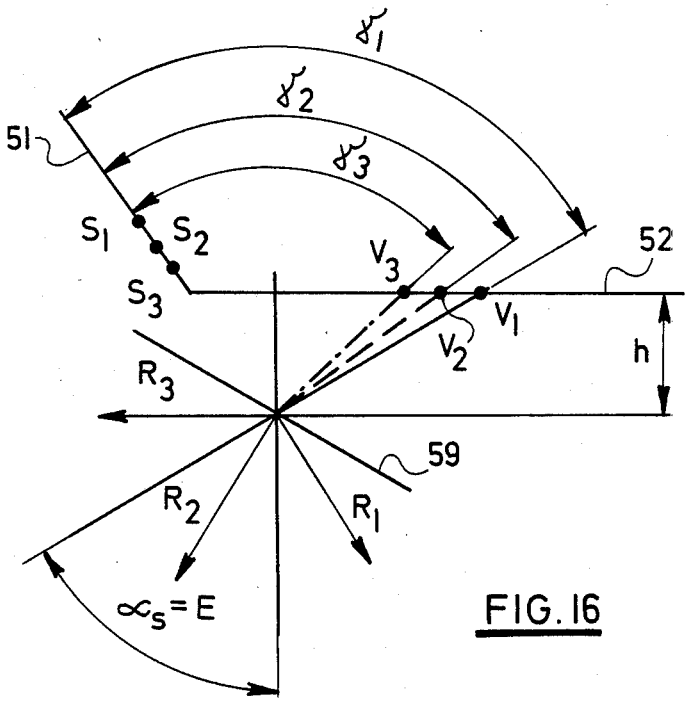

An embodiment of the device according to the present invention will hereinafter be described by way of example with reference to the accompanying drawings in which:

FIG. 1 is a view of a disposition of two metering devices on the frame of a shuttleless loom, designed for selectively releasing a weft thread, FIG. 2 is a view in longitudinal section of an exemplary embodiment of a metering device for selective releasing, FIG. 3 is a front elevational view of a metering device, FIG. 4 is a plan view of a metering device, FIG. 5*a* is a view of a first embodiment of separating wheel having fixed dents for a weft thread releasing program 1:2, FIG 5*b* is a view of a second embodiment of separating wheel having fixed dents for a weft thread releasing program 1:2, FIG. 6 is a view of a third embodiment of separating wheel having fixed dents provided with projections for a weft thread releasing program 1:2, FIG. 7 is a view of a fourth embodiment of separating wheel, said wheel having fixed dents for a weft thread releasing program 2:2, FIG. 8 is a view of a fifth embodiment of separating wheel, said wheel having swingable dents for a weft thread releasing program 1:2, FIG. 9 is a side elevational view of the separating wheel of FIG. 8 having swingable dents for a weft thread releasing program 1:2, FIG. 10 is a view of a sixth embodiment of separating wheel, said wheel having resilient dents for a weft thread releasing program 1:2, FIG. 11 is a view in longitudinal section of an exemplary embodiment of a metering device with a bracket, FIG. 12 is a view in longitudinal section of a metering device having a separating wheel disposed above a supply drum, FIG. 13 is a view of a seventh embodiment of separating wheel, said wheel having fixed dents for a weft thread releasing program 1:2, FIG. 14 shows a time chart for weft thread releasing program 1:3, FIG. 15 shows a diagram of a separating wheel having unequal angular spacings of control means, FIG. 16 shows a diagram of a separating wheel having unequal heights of control means, FIG. 17 shows a time chart for a weft thread releasing program 1:2, and FIG. 18 shows a time chart for a weft thread releasing program 2:2.

The ratios, i.e. 1:1, 2:1, 2:2, etc. determine releasing of individual weft lengths by individual metering devices; 1:1 means, one weft length released by the first metering device, one weft length released by the second metering device; 2:1 means two weft lengths released by the first metering device, one weft length by the second metering device, etc.

FIG. 1 shows a disposition of two devices of the present invention as applied to an air-jet loom. Between a left hand side frame 1 and a right hand side frame 2 of the loom there pass warp threads 3 fed from a warp beam (not shown) through a lease (not shown) into healds 4 fixed in heald frames 5, to form a warp shed 6. The warp threads 3 pass thorough a beat-up reed 7 attached to an oscillatory slay beam 8, attached to which there is a guide comb 9 and having spaced guide teeth, and an inserting mechanism 10. By the interlacing of warp threads 3 with weft threads 16 a fabric 12 is produced at the fell 11 and is held at its selvedges 13 by temples 14, the fabric 12 being wound on a cloth beam (not shown). Attached to the left hand side frame 1 of the loom are two metering devices 15*a*, 15*b*, to be described later on, permitting the selective release of weft threads 16. From the metering devices 15*a*, 15*b* the weft thread 16 is led via respective pincers 17*a*, 17*b* to the inserting mechanism 10 by means of which the weft thread 16 is inserted into the warp shed 6. The metering devices 15*a*, 15*b* are supplied from supply bobbins 18 fixed on a stand of a creel (not shown). The drive to the metering devices 15*a*, 15*b* is derived from a main shaft 19, secured to which there is a drive pulley 20 connected, for example, by an indented cog or "timing" belt 21 to a driven change pulley 22*b* of the metering device 15*b*. A driven change pulley 22*a* is fitted on the metering device 15*a* and is driven by another cog or indented belt 24 disposed under a drive guard 25 attached to the left hand side frame 1 of the loom. When a weft thread releasing program is to be changed, it is necesary to change the speed of the metering devices 15*a*, 15*b* by changing the diameter of the driven pulleys 22*a*, 22*b*, the latter being exchangeable.

The metering devices 15*a* and 15*b* are similar. It will suffice to describe 15*b*, shown in FIGS. 2 and 3 specifically. A box 26 (FIG. 2) of the metering device 15*b* is attached to the left hand side frame 1, (not shown in FIG. 2) of the loom as indicated in FIG. 1. In box 26, supported in first bearings 27, there is rotatably mounted a hollow shaft 28 having a guiding flyer. At the left hand end of the rotary hollow shaft 28, on a cone 29, there is fixed by means of a hollow screw 30 the driven pulley 22*b*. At the right hand end of the driven hollow shaft 28 there is disposed a supply drum 32 supported in second bearings 33 and consisting of a body 34 to which attached by means of first screws 35 is a rear head plate 36. Attached to the rear head plate 36 by means of screws (not shown) is, for example, a worm gear box 37. The rear head plate 36, the body 34 and the gear box 37 are connected by means of a pin 38, a spacer 39 and a nut 40 to a front head plate 41 to form a compact assembly. On the pins 38 there are fastened by second screws 42 a rear cover 43 and, by third screws 44 there are fastened by nuts 47 adjustable band segments 48 and a fixed segment 49, which constitute the surface of the supply drum 32 for depositing the metered weft thread 16 thereon. Each of the segments 48, 49 is comprised of a projection 50 formed by a plane parallel to the longitudinal axis of the drum 32. Said plane merges into an oblique surface 51 and, farther, into a conical portion 52 of the segments 48, 49 in such a way that the diameter of the conical portion 52 diminishes in the direction toward the right, that is, toward the inserting mechanism 10 (not shown in FIG. 2). Each adjustable segment 48 can be displaced in a radial direction as indicated in FIG. 3, at the same time, partially rotated around the pin 46 of the front head plate 41. Upon displacement of the adjustable segment 48 in a radial direction into a position fulfilling the condition for metering the required insertion length of weft thread 16, the adjustable segment 48 is rotated around the pin 46 in such a way that an outer edge 53 of the segment overlaps an inner edge 54 of the respective next segment 48, 49. This arrangement applied to all segments 48, 49, six in the exemplary embodiment shown, guarantees a uniform course of tension in weft thread 16 during its withdrawal from the metering device as well as during insertion into the warp shed 6. Members 48 are adjustable to be able to change the working drum diameter, thus to be able to change length of wound weft yarn when weaving different widths of fabrics.

Into a groove 55 (FIG. 2) of the fixed segment 49 there engages an exchangeable separating wheel 56 fixed by means of a fastening nut 57 to a driven shaft 58 of the gear box 37. To prevent the supply drum 32 from being rotated, the lower portion of said supply drum 32 is provided, for example, with a counterweight (not shown) which keeps the supply drum 32 in its stationary position. Along the periphery of the separating wheel 56 there are distributed control means 59 having, in this instance, unequal heights and different angular spacings, provided for a weft thread releasing program 1:2 into the warp shed 6, to be described hereinafter. The angular position of the control means 59 along the periphery of the separating wheel 56 can be adjusted with respect to the oblique surface 51 of the fixed segment 49 by means of the cone 29 on the hollow shaft 28. The metered insertion length of the weft thread 16 is deposited into a space 60 between the control means 59, and is displaced and released by the control means 59 along the conical portion 52 of the fixed segment 49.

The initial basic adjustment of the separating wheels 56 with regard to the surface 51 of the drum is accomplish by manually rotating the pulley **22*b* (FIG. 2), and together with the pully 22*b* the comb 29 and the whole assembly up to and including the separating wheel 56. This is done with the transmission belt disconnected. The direction of rotation of the wheel 56 (e.g. FIG. 2**) is clockwise.

The drive to the separating wheel 56 is effected, for example, by means of a worm gear (not shown) in the gear box 37, on a drive shaft 61 of which there is fixed a driven gear 62 which meshes with a drive gear 63 fast on the hollow shaft 28. The drive to the metering device is effected in a rotary manner by a connection between the main shaft 19 of the loom and the hollow shaft 28, effected, for example, by means of the drive pulley 20 connected, for example, by means of the cog belts 21, 24, to the driven pulleys **22*a*, 22*b* fixed by the hollow screw 30 on the hollow shaft 28. More specifically, the drive of the metering device is taken from the machine via 19, 20, 21, 22*b*, 23, 14, 22*a*; 22*a*, 22*b*** are exchangeable pulleys of various diameters giving the transmission ratio and thus the speed of the metering devices.

When the weft thread releasing program is changed, the transmission ratio between the main shaft (not shown) and the hollow shaft 28 is changed by changing the diameter of the driven pulley **22*a*, 22*b* of the metering devices 15*a*, 15*b* together with a simultaneous change of the separating wheel 56. The hollow shaft 28 is provided with a bore 64 extending along its axis, at the left hand, entry side of which, intended for the weft thread 16, there is screwed a hollow screew 30 having a weft thread guide 65 cemented to it. The hollow screw 30 secures the driven pulley 22*a*, 22*b* on the cone 29 of the hollow shaft 28. The bore 64 opens, in the inserting direction, into a withdrawal opening 66 which is situated on the circumference of the hollow shaft 28. Into the withdrawal opening 66 there is inserted a guiding flyer consisting of a guide tube 67, into the end of which there are cemented-in the weft thread guides 65, the guide tube 67 being attached, by means of a split sleeve 68 fixedly connected by four screws 69, to the hollow shaft 28. At the exit end of the guide tube 67 there is fixed a guide arm 70 provided at its end above the oblique surface 51 of the supply drum 32 with the weft thread guide 65 for feeding the weft thread 16 onto the oblique surface 51 of the segments 48, 49 and for depositing a weft thread winding into the space 60 between the control means 59 of the separating wheel 56. With other adjustable segments 48, the weft thread 16 is deposited on the oblique surface 51 and then on the conical portion 52**.

Separating wheels 56 are not selected. They are continuously rotated and due to the height and angular spacing of the control members 59 of the two metering devices, they release respective weft lengths according to the selected program (e.g. 1:1, 2:1, etc.).

FIG. 4 is a plan view of one of the metering devices **15*a*, 15*b* according to the present invention, in the fixed segment 49 of which the groove 55 is provided, and having an edge 71 for the separating wheel 56, the axis of which can include with the axis of the supply drum 32 an angle in the range of 1°–90°, the most preferred angle being 45°. In the device shown the axes include an angle of 75°. The edge 71 of the groove 55 of the supply drum 32** is heat hardened or provided with a rotatable roller (not shown).

FIG. **5*a* shows an exchangeable separating wheel 56, the control means 59 of which are in the form of fixed dents 72, 73 with unequal heights of tips 74 of the dents and equal spacings. The height of the individual dents 72, 73 is determined by the weft thread releasing program into the warp shed 6. In the center of the separating wheel 56 there is provided a fixing hole 75 for fixing the wheel 56 to the driven shaft 58 of the gear box 37. The control side 76 of the fixed dent 72, 73 is formed as a straight line or it can also have, for example, a concave shape. The displacing side 77 is convex and its shape is determined by the size of the angle formed by the oblique surface 51**.

FIGS. **5*a*, 5*b*, 6, 7, 8, 9, 10 and 13 illustrate six variations of the separating wheel of FIG. 5*a*. In the figures showing such variations, the same reference characters as those used in FIG. 5*a*** are employed but with addition of a, b, c, d, e, and f, respectively.

FIG. **5*b* illustrates the known exchangeable separating wheel 56*a*, the control means 59*a* of which has the form of fixed dents 72*a*, 73*a* having equal heights and equal angular spacings. For inserting weft thread 16 by using two metering devices 15*a*, 15*b*, one of which is equipped with the separating wheel 56 according to FIG. 5*a* as described hereinabove, it is necessary to provide the other metering device 15*a*, 15*b* with a separating wheel 56*a* according to FIG. 5*b*. On the periphery of the separating wheel 56*a* there are provided fixed dents 72*a*, 73*a* having equal angular spacings and equal heights of the tops 74*a* of the dents, and with equal dimensions of the spaces 60*a*. The control side 76*a* is formed as a straight line and the displacing side 77*a* is convex, its shape being determined by the size of the angle formed by the oblique surface 51 in such a way that it is pushed out from the groove 55 simultaneously with the top 74*a*** of the dent.

FIG. 6 illustrates a separating wheel **56*b* having fixed dents 72*b*, 73*b* designed for a weft thread releasing program 1:2 and having unequal heights of the dents 72*b*, 73*b* and equal angular spacings, the fixed dents 72*b*, 73*b* having the control sides of the tops 74*b* modified by the provision of retaining projections 78*b* to prevent the weft thread 16 from a premature release into the warp shed 6**.

FIG. 7 illustrates a separating wheel **56*c* having fixed dents 72*c*, 73*c* for a weft thread releasing program 2:2, with unequal heights of the dents 72*c*, 73*c*** and unequal angular spacings.

FIGS. 8 and 9 illustrate a separating wheel **56*d* having fixed dents 72*d* and swingable dents 79*d* of equal heights and unequal angular spacings, designed for a weft thread releasing program 1:2. Along the periphery of the separating wheel 56*d* there are alternatively distributed fixed dents 72***d* and swingable dents 79*d*, the latter being swingably mounted on pins 80 fixed in the separating wheel 56*d*. On each pin 80 there is fitted a spring 81 one end of which is secured within a hole provided in the swingable dent 79*d* and the other end of which is secured in a hole provided in the separating wheel 56*d*. By means of a fifth screw 82 a support member 83 is attached to the fixed segment 49, as shown in FIG. 9. On the swingable dent 79*d* there is fixed a small pin 84. The swingable dent 79*d* is fitted in a cut-out provided in the separating wheel 56*d* and forming a tooth 85. It is also possible for the swingable dent 79*d* to have the form of, for example, a cylindrical pin.

In FIG. 10 a separating wheel 56*e* is shown having resilient dents 86 of unequal heights and unequal angular spacings, designed for a weft thread releasing program 1:2. The resilient dents 86, made for example from steel wire, thin sheet metal, and the like, are distributed along the periphery of the separating wheel 56*e* in accordance with the weft thread releasing program and are secured to the separating wheel 56*e* by pressing-in, soldering or cementing.

In FIG. 11 a device described hereinabove is shown, such device being complemented with a bracket 87 attached by means of sixth screws 88 to the box 26 of the metering device. To the end of the bracket 87 extending above the separating wheel 56 a guide member 90 is attached by means of a seventh screw 89, into a guide groove 91 of which engage the control means 59. By means of eighth screw 92 a drum cover 93 for the metering advice 15*a*, 15*b* is attached to the guide member 90. The guide member 90 with its guide groove 91 is preferably made in such a way that at least one control means 59 engages into and is guided by said guide groove 91 as far as the releasing point of the weft thread supply supported behind said control means 59. Thereby the weft thread 16 is prevented from jumping over during displacement thereof, and also rotation of the supply drum 32 by the hollow shaft 28 is avoided so that the drum 32 remains in its stationary position.

A further embodiment of the device according to the present invention is shown in longitudinal section in FIG. 12, which shows the metering device 15*a*, 15*b* having the separating wheel 56 disposed above the supply drum 32. Attached to the machine frame (not shown) there is the box 26 of the metering device, in which the hollow shaft 28 is rotatably supported in the first bearings 27. At the left hand end of the rotary shaft 28 there is secured a toothed drive pulley 94 connected by means of a third cog belt 95 to a toothed driven pulley 96 fixed by a ninth screw 97 on an extended drive shaft 98, whereby a constant transmission is created for the drive to the gear box 37. The extended drive shaft 98 is supported by means of third bearings 100 in a superstructure 99 of the box 26 of the metering device, and is connected to the gear box 37 attached by screws (not shown) to the superstructure 99 of the box 26 of the metering device. On the extended drive shaft 98 of the gear box 37 there is secured by means of the fastening nut 57 the exchangeable separating wheel 56 engaging with its control means 59 into the groove 55 of the fixed segment 49, the latter forming a part of the adjustable supply drum 32 as described hereinabove and supported in the second bearings 33 on the hollow shaft 28. The toothed drive pulley 94, fast on the hollow shaft 28 on the left hand side thereof, is separated by means of a spacing ring 101 from the driven pulley 22*a*, 22*b* fitted on the cone 29 and secured by the hollow screw 30 having the cemented-in weft thread guide 65.

FIG. 13 illustrates exemplary embodiment of a separating wheel 56*f* for the metering device according to FIG. 12, having fixed dents 72*f*, 73*f* of unequal heights and different angular spacings, designed for a weft thread releasing program 1:2. Along the periphery of the separating wheel 56*f* there are distributed fixed dents 72*f*, 73*f* the control sides 76*f* of which have the form of a straight line and the displacing sides 77*f* are concave. The tops 74*f* of the dents have the form of parts of a circle. The height of the dents 72*f*, 73*f* is determined by the corresponding weft thread releasing program.

For all embodiments of the metering devices described hereinabove, it is possible to change the weft thread releasing program by a simple change of the separating wheel 56 and the driven pulleys 22*a*, 22*b*. A method of determining the heights or angular spacings of the control means 59 is shown in FIGS. 14, 15 and 16. For typical representation, a weft thread releasing program 1:3 has been chosen for a continuously rotating separating wheel 56 having six control means 59.

FIG. 14 shows a time chart of operation of the metering device 15*a*, 15*b* releasing a weft thread 16. Points $V_1$, $V_2$, $V_3$, $V_4$ represent the beginning of releasing the weft thread 16 into the inserting mechanism 10 and points $S_1$, $S_2$, $S_3$, $S_4$ represent the beginnings of the pushing-out of the control means 59 and the top 74 of a dent above the oblique metering surface 51. Line segments S1 S2, S2 S3, S3 S1 are equal time periods required to wind an insertion length of weft thread 16 into the space 60 between two control means 59 of the metering device 15*a*. To these time periods there correspond the partial rotation of the separating wheel 56 through an angle E shown in FIG. 15. The line segment S4 S4 then represents a time period for winding an insertion length of weft thread 16 in the metering device 15*b*. The time period V1 V2, V2 V3, V3 V4, V4 V1 is a section of a weaving cycle within which the following steps take place: releasing of the weft thread 16 into the open warp shed 6 with the aid of the inserting mechanism 10, followed by the closing of the pincers 17*a*, 17*b* and beat-up of the weft thread 16 by the beat-up reed 7 into the fell 11 of the fabric 12, with closing of the warp shed 6 and, after interlacing of the warp threads 3 controlled by the healds 4 mounted in the heald frames 5, reopening of the warp shed 6 together with opening of the pincers 17*a*, 17*b* of the corresponding metering device 15*a*, 15*b* which in the next weaving cycle releases the weft thread 16 into the warp shed 6. The cycle of the program takes place within the time period V1 V1 which represents four weaving cycles in the weft thread releasing program 1:3.

The time periods $\gamma 1$, $\gamma 2$, $\gamma 3$, $\gamma 4$ represent time periods of the control means 59 in their operative positions, starting from pushing them out above the oblique surface 51 at point S up to retracting them beneath the conical surface 52 of the supply drum 32 at point V. The angles E of partial rotation of the separating wheel 56 are of constant magnitude, and with the metering device 15*a* there are three of them within the cycle V1 V1 of the program, and with the metering device 15*b* there is one period for winding the weft thread 16 within the cycle V1 V1 of the program. For that reason, the frequency of rotation of the hollow shaft 28 of the weft metering device 15*a* is reduced to $\frac{3}{4}$ of the frequency of rotation of the hollow shaft 28 of a metering device releasing the weft thread windings one after the other. For the metering device 15*b* the frequency of rotation of the hollow shaft 28 is reduced to $\frac{1}{4}$ of the frequency of rotation of the hollow shaft 28 of a metering device releasing the weft thread windings one after the other. Thus the metering device 15*b* regularly releases at point V4 the weft thread windings, one after the other, at a reduced frequency or rotation. From the time chart in FIG. 14, showing the operation of the metering device 15*a*, a demand is evident for different time periods $\gamma 1$, $\gamma 2$, $\gamma 3$ within which the individual control means 59 find themselves in their operative positions between points S and V. If the time period $\gamma 3$ is considered to be a basic one, then in the next time periods $\gamma 1$, $\gamma 2$ it is necessary successively to change the time periods by deviations of time periods $\Delta\gamma 1$, $\Delta\gamma 2$, $\Delta\gamma 3$ and the deviations of angles $\Delta\alpha 1$, $\Delta\alpha 2$, $\Delta\alpha 3$, corresponding thereto, of the displacement of the tops 74 of the dents into their positions permitting releasing of the weft thread windings in accordance with the releasing program. For the deviations of the time periods $\Delta\gamma 1$, $\Delta\gamma 2$, $\Delta\gamma 3$ the following relations are applied:

$$\Delta\gamma 1=\gamma 1-\gamma 3$$

$$\Delta\gamma 2=\gamma 2-\gamma 1$$

$$\Delta\gamma 3=\gamma 3-\gamma 2$$

On the grounds of the deviations of time periods $\Delta\gamma 1$, $\Delta\gamma 2$ $\Delta\gamma 3$ which are found, it is possible, with the aid of a gear ratio constant k, to determine the deviations of angular spacings $\Delta\alpha 1$, $\Delta\alpha 2$, $\Delta\alpha 3$ according to the following relations:

$$\Delta\alpha 1=\alpha 1-\alpha 3=k\cdot\Delta\gamma 1$$

$$\Delta\alpha 2=\alpha 2-\alpha 1=k\cdot\Delta\gamma 2$$

$$\Delta\alpha 3=\alpha 3-\alpha 2=k\cdot\Delta\gamma 3$$

The displacement of the tops 74 of the dents can be an angular one brought about by changing the spacing of the dents, as shown in FIG. 15, or their height, as shown in FIG. 16, and possible both their spacing and their height.

FIG. 15 shows diagrammatically a separating wheel 56 on the periphery of which there are distributed six control means 59 having equal heights, for example, resilient dents 86 or swingable dents 79, with different angular spacings $\alpha 1$, $\alpha 2$, $\alpha 3$. The circular trajectory of the tops of the control means 59 passes through the oblique surface 51 at point S, at which the control means 59 are pushed out into their operative positions with the conical portion 52 at point V, at which the weft thread winding is released into the warp shed 6. A broken line indicates the position of a control means 59 at a moment at which it has been pushed out above the oblique surface 51 at point S.

the angles E represent angular spacings of the control means 59, required for winding insertion lengths of weft threads 16. To calculate the angle E the following relation applied:

$$E=360°/Z$$

where Z=total number of control means 59 on the periphery of the separating wheel 56.

Between the angles E representing the angular spacing of the control means 59, required for winding an insertion length of the weft thread 16, and the angular spacings $\alpha 1$, $\alpha 2$, $\alpha 3$ the following relation applied:

$$\alpha 1+\alpha 2+\alpha 3=3E$$

From the above relations it is possible to determine mathematically the magnitude of the angular spacings $\alpha 1$, $\alpha 2$, $\alpha 3$.

FIG. 16 shoss diagrammatically a separating wheel 56 on the periphery of which there are distributed six control means 59 having unequal heights and equal angular spacings of, for example, fixed dents 72, 73. In this case there will be three releasing points $V_1$, $V_2$, $V_3$ of a weft thread winding. Points $S_1$, $S_2$, $S_3$ represent points at which the top 74 of a dent is pushed out above the oblique metering surface 51. Radius $R_3$ is the smallest radium measured from the center of the separating wheel 56 to the top $V_3$. The radii $R_1$, $R_2$ are radii of the tops $V_1$, $V_2$ measured from the center of the separating wheel 56. The time periods $\gamma 1$, $\gamma 2$, $\gamma 3$ are time periods between points $S_1$, $S_2$, $S_3$ and $V_1$, $V_2$, $V_3$ at which the control means 59 is pushed out above the oblique surface 51, and points $V_1$, $V_2$, $V_3$ indicate releasing of a weft thread winding of an insertion length into the warp shed 6 due to the retracting of the control means 59 into the conical portion 52 of the supply drum 32.

The unequal height $R_1$ of the dents of the separating wheel 56 can be determined, for example, from the smallest height $R_3$ of the dents, measured from the center of the separating wheel 56, from the distance h of the center of the separating wheel 56 to the conical portion 52 and from the angular spacings $\alpha 1$, $\alpha 2$, $\alpha 3$ according to the relation $$R_i=\frac{h}{\cos\sum_{i=1}^{3}(E-\alpha_i)+\arccos\frac{h}{R_3}}$$

The qualities given above are defined as follows:

V=moment of releasing the weft $\gamma$=time period for raising the control means 59 above the oblique surface 51 up to retracting the control means 59 beneath the conical surface 52.

$\alpha$=angular spacing of control means 59.

R=height of the control means 59.

S=point where the control means 59 emerges above the oblique surface 51.

E=angular spacing of the control means 59.

On the grounds of the dependencies mentioned hereinabove, it is also possible to calculate the height of the top 74 of a dent for a separating wheel 56 having control means 59 of unequal heights and unequal spacings. A thus produced separating wheel 56 has been shown in FIG. 7. An advantage resides, above all, in that a change in the angular spacing results in a reduction of the height of the top 74 of the dent and, thereby, in a reduction of the diameter of the separating wheel 56, which is important from the point of view of its being built into the supply drum 32.

FIG. 17 shows a time chart for a weft thread releasing program 1:2, namely one cycle of the program for the two metering devices 15*a*, 15*b*. Points V1, V2, V3 are the beginnings of releases of a weft thread winding into the warp shed 6. Points S1, S2, S3 are the beginnings of winding of a weft thread winding having an insertion length. Line segments S1 V2, S2 V1, S3 V3 are displacing sections of a weft thread winding having an insertion length, toward the point of its release into the warp shed 6.

FIG. 18 shows a time chart for weft thread releasing program 2:2, namely one cycle of the program for the two metering devices 15*a*, 15*b*. Points V1, V2, V3 are the beginnings of releases of a weft thread winding into the warp shed 6. Points S1, S2, S3, S4 are the beginnings of winding a weft thread winding of insertion length. Line segments S1 V2, S2 V1, S4 V3, S3 V4 are displacing sections of a weft thread winding having an insertion length, toward the point of its release into the warp shed 6.

The metering device according to the present invention, as shown in FIG. 2, operates as follows:

The hollow shaft 28 is continuously rotated, while the stationary supply drum 32 is kept in its stationary position because in the lower portion of the supply drum 32, on the adjustable segment 48, there are disposed either a counterweight or permanent magnets (not shown), the countermagnets of which are secured on the left hand side frame 1 of the loom. The weft thread 16 is continuously wound on the oblique surface 51, being fed from the supply bobbin 18 into the hollow screw 30, wherein it passes through the cemented-in weft thread guide 65 and thence into the bore 64 of the hollow shaft 28. Thereafter the weft thread 16 passes through the weft guide 65 fast in the guide tube 67, one end of which engages into the withdrawal opening 66 in which the guide tube 67 is secured by means of the split sleeve 68. After having passed through the guide tube 67, the weft thread 16 leaves the weft thread guide 65 provided at the end of the tube 67 and is led by another weft thread guide 65 fixed in the guide arm 70 above the oblique surface 51 of the supply drum 32 around which it is continuously rotated and is wound onto the oblique surface 51. The weft thread 16 is wound into the gap 60 between two control means 59 in such a way that the first control means 59, for example a fixed dent 72 of the separating wheel 56 as shown in FIG. 5*a*, retains by its control side 76 the weft thread winding on the conical portion 52 of the supply drum 32.

As soon as a complete insertion length of the weft thread 16 has been wound, it is separated from the next weft thread windings to be wound by the next fixed dent 73 pushed out above the oblique surface 51. The weft thread winding of an insertion length is displaced by the displacing side 77 of the fixed dent 73 along the conical portion 52 of the supply drum 32 until the moment when the weft thread winding is released into the inserting mechanism 10 in due time to insert the weft thread 16 into the warp shed 6. The weft thread winding is released by retracting the top 74 of the fixed dent 72 under the surface of the conical portion 52 of the fixed segment 49 of the supply drum 32. At this moment at least one coil of weft thread 16 from the total insertion length of the weft thread 16 has been wound behind the next fixed dent 73.

The drive to the separating wheel 56 is derived from the hollow shaft 28 on which is fitted the drive gear 63 driving the driven gear 62 fast on the drive shaft 61 of the gear box 37. The rotary motion of the drive shaft 61 of the gear box 37 is transmitted by a worm gearing (not shown) onto the driven shaft 58 on which is secured by means of the fastening nut 57 the separating wheel 56 is continuously rotated and displaces a weft thread winding of an insertion length toward the inserting mechanism 10. In order to prevent the weft thread winding from being prematurely released from the space 60, it is possible to provide the control side 76 at the top 74 with a retaining projection 78, as shown in FIG. 6, which prevents the weft thread winding from slipping off the control side 76 of the fixed dent 72, 73 until the top 74 of the dent is retracted under the level of the conical portion 52 of the fixed segment 49 of the supply drum 32.

The separating wheel 56*d*, as shown in FIGS. 8 and 9, fast on the driven shaft 58 of the gear box 37 of the metering device 15*a*, 15*b* described hereinbefore, controls the releasing of the weft thread winding into the inserting mechanism 10 by means of fixed dents 72*d* and swingable dents 79*d*. The weft thread winding of an insertion length is wound into the space 60*d* between the fixed dent 72*d* and the swingable dent 79*d*. When the winding behind the fixed dent 72*d* is completed, the swingable dent 79*d* is pushed out above the oblique surface 51 of the supply drum 32. Before the top 74*d* of the dent is pushed out from the groove 55, the swingable dent 79*d* is retained in that the small pin 84 runs on the support member 83 secured by the fifth screw 82 beneath the oblique surface 51 of the fixed segment 49. By means of the small pin 84 the support member 83 retains the swingable dent 79*d* in its ascending trajectory until the moment when the swingable dent 79*d* abuts against the tooth 85 formed in the separating wheel 56*d*. Thereafter the swingable dent 79*d* is carried by the rotating separating wheel 56*d* until the moment when the small pin 84 slips off the support member 83 and the swingable dent 79*d* is returned by means of the spring 81 into its basic position, whereby the swingable dent 79*d* is pushed out from the groove 55 of the fixed segment 49.

The moment of the push-out of the top 74 of the swingable dent 79*d* is determined, for example, by point S2 of the time chart in FIG. 17. A weft thread winding is wound behind the projecting swingable dent 79*d*. The preceding fixed dent 72*d*, in its descending trajectory into the groove 55 of the fixed segment 49 and upon retraction of the top 74*d* of the fixed dent 72*d* under the conical portion 52 of the fixed segment 49, releases the weft thread winding, lying behind it, into the inserting mechanism 10. Behind the swingable dent 79*d*, held by the spring 81 in its basic position, a weft thread winding is being wound and as the insertion length thereof is attained it is separated from the next weft thread windings to be wound by the next fixed dent 72*d* which is pushed out. The swingable dent 79*d* releases the weft thread winding lying behind it by means of the top 74*d* at a moment when there are one or two coils of weft thread 16 from the total insertion length wound behind the next fixed dent 72*d*. Here an advantage resides particularly in the reduction of diameter of the separating wheel 56*d* due to the lowering of the tops 74*d* of the swingable dents 79*d*, while the program of releasing the weft thread 16 into the inserting mechanism 10 of the loom is maitained.

It is possible to produce a separating wheel 56 having swingable dents 79 and fixed dents 72, the tops 74 of which have equal spacings, when they are in their basic positions. Deflection of the swingable dents 79 then takes place on the descending trajectory of the swingable dent 79 with the aid of the small pin 84 and the support member 83, in which case the support member 83 is secured beneath the conical portion 52 of the fixed segment 49.

The metering device 15*a*, 15*b* can be equipped with a separating wheel 56*e* having resilient dents 86 of unequal heights and unequal angular spacings, as shown in FIG. 10; in the space 60*e* between two resilient dents 86 the device displaces the weft thread winding along the conical portion 52 of the supply drum 32, as has been described hereinbefore.

Pushing-out of a longer resilient dent 86 from the groove 55 of the fixed segment 49 takes place as follows:

The resilient dent 86 with its displacing side 77*e* in its ascending trajectory is retained by the edge 71 of the groove 55 under the oblique surface 51 of the fixed segment 49 until the moment when the top 74*e* of the dent is out of engagement and erects into its operative position above the surface of the fixed segment 49. When the resilient dent 86 is pushed out, coils of weft thread 16 are wound behind it. The resilient dent 86 with its displacing side 77*e* displaces, in front of it, the weft thread winding of an insertion length to the point of releasing into the warp shed 6 of the loom. It is advisable to treat the edge 71 against abrasion, for example harden it by heat treatment, or to manufacture it as a rotary roller.

The metering device 15*a*, 15*b* as shown in FIG. 11 winds and releases a weft thread winding as follows:

In the course of each working cycle of the loom the hollow shaft 28 performs as many revolutions as needed, in accordance with the required metered length of weft thread 16. The supply drum 32 formed of adjustable segments 48 and a fixed segment 49 is kept in its stationary position in that at least one control means 59 of the separating wheel 56 passes through the guide groove 91 of the guide member 90. Conjointly with rotation of the hollow shaft 28 the separating wheel 56 is also rotated, between the control means 59 of which, in the space 60, a control means 59 displaces by means of its displacing side 77 always at least one complete insertion length of weft thread 16 along the supply drum 32 in the direction of withdrawal of the weft thread 16. The weft thread 16 is retained in the space 60 in that the control means 59 passes through the guide groove 91 of the guide member 90 and retains the weft thread 16 between the fixed segment 49 and the guide member 90 until the moment when the weft thread 16 is released into the warp shed 6 under simultaneous opening of the pincers 17*a*, 17*b* of the inserting mechanism 10; at this moment there are one to two coils of weft thread 16 wound in the next space 60.

The rotating guide tube 67 with the guide arm 70 continuously winds the weft thread 16 on the oblique surface 51, the weft thread 16 being fed from the supply bobbin 18, through the hollow screw 30 into the bore 64 of the hollow shaft 28 and through the withdrawal opening 66 into the guide tube 67 with the guide arm 70, via the weft thread guides 65 which reduce friction of the weft thread 16. The weft thread 16 is metered on the oblique surface 51 and is separated from the next weft thread winding by pushing out the control means 59 from the groove 55 at the location of the oblique surface 51. The control means 59 displaces, in front of it, one complete insertion length of the weft thread 16 along the conical portion 52 of the supply drum 32, whereby the tension in the weft thread coils is reduced. At the moment when the top 74 of the dent is retracted under the surface of the conical portion 52 of the fixed segment 49, the weft thread 16 is released to be inserted into the warp shed 6. After each control means 59 the whole cycle is continuously repeated.

The metering device 15*a*, 15*b* as shown in FIGS. 12 and 13 operates substantially in the manner described hereinbefore, a modification residing in that the drive to the worm gear box 37 is derived from the hollow shaft 28 by means of the toothed drive pulley 94 which by means of the third cog belt 95 drives the toothed driven pulley 96 secured by the ninth screw 97 to the extended drive shaft 98 of the worm gear box 37. Rotating with the driven shaft 58 of the worm gear box 37 is the separating wheel 56*f* located above the fixed segment 49 of the supply drum 32, through the groove 55 of which pass the control means 59 formed, for example, as fixed dents 72*f*, 73*f* as shown in FIG. 13. The winding of weft thread 16 of an insertion length is then transferred in the space 60*f* between two control means 59*f* and the conical portion 52*f* of the fixed segment 49 up to the moment when the weft thread winding is released into the warp shed 6 by pushing-out the top 74*f* of the dent above the surface of the supply drum 32.

When a separating wheel 56 having fixed dents 72*f*, 73*f*, as shown in FIG. 13, is replaced by a separating wheel 56*e* having resilient dents 86, as shown in FIG. 10, the dents 86 are controlled by the edge 71*e* of the groove 55 of the fixed segment 49 of the supply drum 32.

In case a separating wheel 56*d* having swingable dents 79*d* is to be used, it is necessary to attach the supporting member 83 above the surface of the supply drum 32 to the superstructure 99 of the box 26 of the metering device 15*a*, 15*b*. When the groove 55 for the separating wheel 56*d* is formed in the fixed segment 49 under an angle included between the axis of the separating wheel 56*d* and the axis of the supply drum 32 consisting of segments 48, 49, which is smaller than 90° and greater than 1°, then the path over which the weft thread winding is to be displaced along the conical portion 52 of the supply drum 32 is reduced. Thus for an angle of, for example, 45° the path of displacement of the weft thread winding will amount to approximately two thirds of a path which the weft thread winding covers in case of an angle of 90°.

Therefore, when it is desired for the fabric 12 to be, for example, a weft cord or to be reinforced in the ground texture by releasing the weft thread 16 into the warp shed 6 under a weft thread releasing program 1:2, it is necessary for the metering device 15*a* to be equipped with a separating wheel 56, for example according to FIG. 5*a*, having unequal heights of the control means 59, and for the metering device 15*b* to be equipped with a separating wheel 56*a* according to FIG. 5*b*, having both equal heights and equal angular spacings of the control means 59*d*. The speed of the metering device 15*a* amounts to two-thirds of that of the device releasing weft threads 16 one after another. The speed of the metering device 15*b* amounts then to one-third of that of the device releasing weft threads 16 one after another.

FIG. 17 shows a weft thread releasing program 1:2. At the moment under consideration, i.e. the beginning V1 of releasing of weft thread 16 from the metering device 15*a* into the inserting mechanism 10, the pincers 17*a* are opened and the weft thread 16 is being inserted into the warp shed 6. In the metering device 15*b* there are wound two-thirds of the insertion length of the weft thread winding. After the weft thread 16 has been inserted by the inserting mechanism 10 into the warp shed 6, the pincers 17*a* of the metering device 15*a* are closed, the latter winding the next weft thread winding, the beginning of the winding operation being denoted as S1. Simultaneously the beat-up movement of the beat-up reed 7 is terminated, and with it the whole weaving cycle.

When considering, for example, the separating wheel 56 as shown in FIG. 5*a*, the highest fixed dent 73 at this moment is releasing the insertion length of weft thread 16 wound behind it in the space 60. The weft thread winding is being displaced by the next fixed dent 72, by the concave displacing side 77 thereof, along the conical portion 52 of the supply drum 32, until the moment when the control side 76, retaining until now the weft thread 16, released the same by retracting the top 74 under the level of the surface of the fixed segment 49. With the metering device 15*a*, 15*b* according to FIG. 12, releasing of the weft thread 16 takes place by pushing out the top 74 of the dent above the surface of the conical portion 52 of the fixed segment 49 of the supply drum 32. At the same time a new supply of weft thread 16 is being wound behind the next fixed dent 72 of the metering device 15*a*, which is released at V2 in the next weaving cycle.

At the releasing moment V2 a supply of weft thread 16 of an insertion length is wound in the metering device 15*b*, while the metering device 15*a* releases the wound supply of weft thread 16 of an insertion length to be inserted by the inserting mechanism 10 of the loom, after the weft thread 16 has been released by both the pincers 17*a* and the top 74 of the dent. By closing the pincers 17*a* and beating-up the weft thread 16 by the beat-up reed 7 the second weaving cycle is terminated. Before the weft thread 16 has been released at V2, the metering device 15*a* starts to wind a weft thread 16 behind the higher fixed dent 73 at S1. In the third weaving cycle the weft thread winding is released at the moment V3 and after opening of the pincers 17*b* the weft thread 16 is propelled by means of the inserting mechanism 10 into the warp shed 6, and after closing of the pincers 17*b* a beat-up is effected by the beat-up reed 7. At the same time, before the weft thread winding is released into the warp shed 6 at V3, the metering device 15*b* starts to wind a weft thread winding at S3. The metering device 15*a* has a weft thread winding of an insertion length deposited behind a fixed dent and displaces it along the conical portion 52 of the supply drum 32 until the moment V1 when the weft thread 16 is released in the next weaving cycle by which the whole weft thread releasing program 1:2 is repeated.

From what has been said hereinbefore, it follows that to change the weft thread releasing program 1:3, 1:4, etc. it is sufficient to substitute the separating wheel 56 in the metering device 15*a* by another one, the control means 59 of which corresponds, due to the distribution of the tops 74 of its dents, to the desired weft thread releasing program. At the same time the driven pulley 22*a* of the metering device 15*a* and the driven pulley 22*b* of the metering device 15*b* are changed so that the frequency of rotation of the respective metering devices 15*a*, 15*b* corresponds to the weft thread releasing program 1:3, 1:4, etc.

When it is desired that the fabric 12 be, for example, in twill weave or reinforced in the ground texture by releasing the weft threads 16 into the warp shed 6 under the weft thread releasing program 2:2, then it is necessary for the metering device 15*a*, 15*b* to be equipped, for example, with a separating wheel 56*c* as shown in FIG. 7, having unequal heights of the tops 74*c* of the dents and unequal angular spacings of the control means 59*c*. The speeds of the metering devices 15*a*, 15*b* are the same, and they amount to one-half of that of the device which releases the weft threads 16 one after another.

FIG. 18 shows a weft thread releasing program 2:2. At the moment under consideration, i.e. at the beginning V1 of releasing a weft thread 16 from the metering device 15*a* into the inserting mechanism 10, the pincers 17*a* are opened and the weft thread 16 is inserted into the warp shed 6. In the measuring device 15*a* the highest fixed dent 73 was releasing a weft thread winding lying behind it in the space 60. At the same time, at S2, winding of weft thread 16 takes place behind the fixed dent 72 into the space 60. In the metering device 15*b*, at S3, winding of weft thread 16 takes place behind the highest fixed dent 73 into the space 60. When the pincers 17*a* have been closed, the weft thread 16 is beaten-up by the beat-up reed 7 into the fell 11 of the fabric 12. In the next weaving cycle, after the pincers 17*a* have been opened, the metering device 15*a* releases, at V2, the weft thread winding into the inserting mechanism 10. After the pincers 17*a* have been closed, a beat-up by the beat-up reed 7 is carried out and, at the same time, one to two coils of weft thread 16 are wound behind the fixed dent 73. The metering device 15*b* displaces a weft thread winding deposited behind the highest fixed dent 73 of the separating wheel 56, toward the inserting mechanism 10 and, at the same time, winds a weft thread winding behind the fixed dent 72.

In the third weaving cycle, after the pincers 17*b* have been opened, the metering device 15*b* releases, at V3, a weft thread winding and the same is inserted by the inserting mechanism 10 into the warp shed 6. At this moment the highest fixed dent 73 of the metering device 15*b* was releasing the weft thread 16, wherein winding was continued behind the next fixed dent 72 of the separating wheel 56. In the metering device 15*a* a supply of weft thread 16 is being wound behind the highest fixed dent 73 of the separating wheel 56. After the pincers 17*b* have been closed, the beat-up reed 7 beats up the weft thread 16 into the fell 11 of the fabric 12. In the fourth weaving cycle, after the pincers 17*b* have been opened, the metering device 15*b* releases the weft thread winding, at V4, transferred by the fixed dent 72 and the weft thread 16 is inserted by the inserting mechanism 10 into the shed 6, while winding of weft thread 16 was started behind the highest dent 73 of the separating wheel 56 of the same device. In the metering device 15*a* the weft thread winding behind the fixed dent 73 is being displaced toward the inserting mechanism 10 and, at the same time, a weft thread winding is being wound behind the fixed dent 72. After the pincers 17*b* have been closed, a beat-up is carried out by the beat-up reed 7 and the weaving cycle is completed. After four weaving cycles the whole program is repeated.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Apparatus for selectively releasing a predetermined length of weft thread into the warp shed in shuttleless looms, comprising at least two continuously rotating metering devices attached to the frame of the machine, means for winding the weft thread about a supply drum and at each time period for separating a certain number of weft thread coils, corresponding to an insertion length of weft thread, by control means fast on the circumference of a separating wheel from the next weft thread windings and released into an inserting mechanism of the loom, the frequency of rotation of the two metering devices being chosen in such a way that said devices conjointly wind or release one insertion length of the weft thread for one weaving cycle, and at least one of them releases an insertion length of the weft thread in at least subsequent consecutive weaving cycles, the ratio of the frequencies of rotation of the metering devices being equal to the numbers of weft thread lengths released at each time period directly, one after another, by each of said devices, each of said devices comprising a box of the metering device, attached to the frame of the shuttleless loom in which there is mounted by means of first bearings a rotary hollow shaft having a guide flyer, at one end of which is secured a driven pulley conjointly rotatably connected by a transmission to a main shaft of the shuttleless loom, and at the other output end there is mounted in second bearings the supply drum consisting of at least one adjustable segment and at least one fixed segment, onto which the weft thread is continuously wound, in the fixed segment there being provided at least one groove for at least one separating wheel fast on a driven shaft of a gear box rotatably connected to said hollow shaft, the prepared weft thread winding corresponding to at least one insertion length of weft thread being displaced by the separating wheel along the supply drum in the direction of withdrawal of the weft thread, on the periphery of the separating wheel there being disposed control means, the weft thread winding, corresponding to the insertion of weft thread, always being displaced between two of said control means, the first control means in the direction of withdrawal of the weft thread selectively releasing into the warp shed a winding of weft thread carried behind it, in accordance with a weft thread releasing program, on the periphery of the separating wheel there being disposed at least three control means at equal angular spacings, their different relative heights being determined by a program for releasing the weft thread into the warp shed, the angle included between the axis of the supply drum and the axis of the separating wheel is in the range of 1°–89°, and the control means distributed on the periphery of the separating wheel being formed as swingable dents.

2. Apparatus for selectively releasing a predetermined length of weft thread into the warp shed in shuttleless looms, comprising at least two continuously rotating metering devices attached to the frame of the machine, means for winding the weft thread about a supply drum and at each time period for separating a certain number of weft thread coils, corresponding to a insertion length of weft thread, by control means fast on the circumference of a separating wheel from the next weft thread windings and released into an inserting mechanism of the loom, the frequency of rotation of the two metering devices being chosen in such a way that said devices conjointly wind or release one insertion length of the weft thread for one weaving cycle, and at least one of them releases an insertion length of the weft thread in at least subsequent consecutive weaving cycles, the ratio of the frequencies of rotation of the metering devices being equal to the numbers of weft thread lengths released at each time period directly, one after another, by each of said devices, each of said devices comprising a box of the metering device, attached to the frame of the shuttleless loom in which there is mounted by means of first bearings a rotary hollow shaft having a guide flyer, at one end of which is secured a driven pulley conjointly rotatably connected by a transmission to a main shaft of the shuttleless loom, and at the outer output end there is mounted in second bearings the supply drum consisting of at least one adjustable segment and at least one fixed segment, onto which the weft thread is continuously wound, in the fixed segment there being provided at least one groove for at least one separating wheel fast on a driven shaft of a gear box rotatably connected to one end of which is secured a driven pulley conjointly rotatably connected by a transmission to a main shaft of the shuttleless weaving machine, and at the other output end is mounted in second bearings the supply drum consisting of at least one adjustable segment and at least one fixed segment, onto which the weft thread is continuously wound, in the fixed segment, onto which the weft thread is continuously wound, in the fixed segment there being provided at least one groove for at least one separating wheel fast on a driven shaft of a gear box rotatably connected to said hollow shaft, the prepared weft thread is continuously wound, in the fixed segment there being provided at least one groove for at least one separating wheel fast on a driven shaft of a gear box rotatably connected to said hollow shaft, the prepared weft thread winding corresponding to at least one insertion length of weft thread being displaced by the separating wheel along the supply drum in the direction of withdrawal of the weft thread, on the periphery of the separating wheel there being disposed control means, the weft thread winding, corresponding to the insertion of weft thread, being displaced always between two of said control means, the first control means in the direction of withdrawal of the weft thread always selectively releases into the warp shed a winding of weft thread carried behind it, in accordance with a weft thread releasing program, on the periphery of the separating wheel there being distributed at least three control means, the heights and angular spacings of which being determined by a program for releasing the weft thread into the warp shed, the control means distributed on the periphery of the separating wheel being formed as resilient dents.

3. Apparatus as claimed in claim 2, wherein the gear box together with the separating wheel having the control means distributed on the periphery thereof, are located outside the supply drum comprised of the segments, above the fixed segment into the groove of which, adapted as a guide member, engage the control means.

4. Apparatus as claimed in claim 2, wherein a retaining projection is formed at the top of a dent of a control means.

5. Apparatus for selectively releasing a predetermined length of weft thread into the warp shed in shuttleless looms, comprising at least two continuously rotating metering devices attached to the frame of the machine, means for winding the weft thread about a supply drum and at each time period for separating a certain number of weft thread coils, corresponding to an insertion length of weft thread, by control means fast on the circumference of a separating wheel from the next weft thread windings and released into an inserting mechanism of the loom, the frequency of rotation of the two metering devices being chosen in such a way that said devices conjointly wind or release one insertion length of the weft thread for one weaving cycle, and at least one of them releases an insertion length of the weft thread in at least subsequent consecutive weaving cycles, the ratio of the frequencies of rotation of the metering devices being equal to the numbers of weft thread lengths released at each time period directly, one after another, by each of said devices, each of said devices comprising a box of the metering device, attached to the frame of the shuttleless loom in which there is mounted by means of first bearings a rotary hollow shaft having a guide flyer, at one end of which is secured a driven pulley conjointly rotatably connected by a transmission to a main shaft of the shuttleless loom, and at the other output end there is mounted in second bearings the supply drum consisting of at least one adjustable segment and at least one fixed segment, onto which the weft thread is continuously wound, in the fixed segment there being provided at least one groove for at least one separating wheel fast on a driven shaft of a gear box rotatably connected to said hollow shaft, the prepared weft thread winding corresponding to at least one insertion length of weft thread being displaced by the separating wheel along the supply drum in the direction of withdrawal of the weft thread, on the periphery of the separating wheel there being disposed control means, the weft thread winding, corresponding to the insertion of weft thread, always being displaced between two of said control means, the first control means in the direction of withdrawal of the weft thread selectively releasing into the warp shed a winding of weft thread carried behind it, in accordance with a weft thread releasing program, on the periphery of the separating wheel there being disposed at least three control means at equal angular spacings, their different relative height being determined by a program for releasing the weft thread into the warp shed.

6. Apparatus according to claim 5, wherein the control means distributed on the periphery of the separating wheel are formed as fixed dents, the angle included between the axis of the supply drum and the axis of the separating wheel being in the range of 1°–89°.

7. Apparatus for selectively releasing a predetermined length of weft thread into the warp shed in shuttleless looms, comprising at least two continuously rotating metering devices attached to the frame of the machine, means for winding the weft thread about a supply drum and at each time period for separating a certain number of weft thread coils, corresponding to an insertion length of weft thread, by control means fast on the circumference of a separating wheel from the next weft thread windings and released into an inserting mechanism of the loom, the frequency of rotation of the two metering devices being chosen in such a way that said devices conjointly wind or release one insertion length of the weft thread for one weaving cycle, and at least one of them releases an insertion length of the weft thread in at least subsequent consecutive weaving cycles, the ratio of the frequencies of rotation of the metering devices being equal to the numbers of weft thread lengths released at each time period directly, one after another, by each of said devices, each of said devices comprising a box of the metering device, attached to the frame of the shuttleless loom in which there is mounted by means of first bearings a rotary hollow shaft having a guide flyer, at one end of which is secured a driven pulley conjointly rotatably connected by a transmission to a main shaft of the shuttleless loom, and at the other output end there is mounted in second bearings the supply drum consisting of at least one adjustable segment and at least one fixed segment, onto which the weft thread is continuously wound, in the fixed segment there being provided at least one groove for at least one separating wheel fast on a driven shaft of a gear box rotatably connected to said hollow shaft, the prepared weft thread winding corresponding to at least one insertion length of weft thread being displaced by the separating wheel along the supply drum in the direction of withdrawal of the weft thread, on the periphery of the separating wheel there being disposed control means, the weft thread winding, corresponding to the insertion of weft thread, always being displaced between two of said control means, the first control means in the direction of withdrawal of the weft thread selectively releasing into the warp shed a winding of weft thread carried behind it, in accordance with a weft thread releasing program, on the periphery of the separating wheel there being distributed at least three control means of equal heights, their unequal angular spacings being determined by a program for releasing the weft thread into the warp shed.

8. Apparatus for selectively releasing a predetermined length of weft thread into the warp shed in shuttleless looms, comprising at least two continuously rotating metering devices attached to the frame of the machine, means for winding the weft thread about a supply drum and at each time period for separating a certain number of weft thread, by control means fast on the circumference of a separating wheel from the next weft thread windings and released into an inserting mechanism of the loom, the frequency of rotation of the two metering devices being chosen in such a way that said devices conjointly wind or release one insertion length of the weft thread for one weaving cycle, and at least one of them releases an insertion length of the weft thread in at least subsequent consecutive weaving cycles, the ratio of the frequencies of rotation of the metering devices being equal to the numbers of weft thread lengths released at each time period directly, one after another, by each of said devices, each of said devices comprising a box of the metering device, attached to the frame of the shuttleless loom in which there is mounted by means of first bearings a rotary hollow shaft having a guide flyer, at one end of which is secured a driven pulley conjointly rotatably connected by a transmission to a main shaft of the shuttleless loom and at the other output end there is mounted in second bearings the supply drum consisting of at least one adjustable segment and at least one fixed segment, onto which the weft thread is continuously wound, in the fixed segment there being provided at least one groove for at least one separating wheel fast on a driven shaft of a gear box rotatably connected to said hollow shaft, the prepared weft thread winding corresponding to at least one insertion length of weft thread being displaced by the separating wheel along the supply drum in the direction withdrawal of the weft thread, on the periphery of the separating wheel there being disposed control means, the weft thread winding, corresponding to the insertion of weft thread, the first control means in the direction of withdrawal of the weft thread selectively releasing into the warp shed a winding of weft thread carried behind it, in accordance with a weft thread releasing program, on the periphery of the separating wheel there being distributed at least three control means, the heights and angular spacings of which being determined by a program for releasing the weft thread into the warp shed.

* * * * *